United States Patent [19]

Peterson

[11] 4,011,150

[45] Mar. 8, 1977

[54] METHOD OF TREATING REFINING SEGMENTS

[75] Inventor: Per Viking Peterson, Sundsvall, Sweden

[73] Assignee: SCA Development Aktiebolag, Sundsvall, Sweden

[22] Filed: Apr. 28, 1975

[21] Appl. No.: 571,910

[30] Foreign Application Priority Data

May 10, 1974 Sweden ..... 7406259

[52] U.S. Cl. ..... 204/129.35; 156/645

[51] Int. Cl.[2] ..... C25F 3/06; C25F 3/02

[58] Field of Search ..... 204/129.35, 129.1; 156/3, 6, 7, 18

[56] References Cited

UNITED STATES PATENTS

| | | | |
|---|---|---|---|
| 3,347,760 | 10/1967 | McKelvie | 204/129.35 |
| 3,689,387 | 9/1972 | Jumer | 204/129.35 |

FOREIGN PATENTS OR APPLICATIONS

| | | | |
|---|---|---|---|
| 703,838 | 2/1954 | United Kingdom | 204/129.35 |

OTHER PUBLICATIONS

Electrolytic Polishing by J. S. Crout, *Metal Industry*, June 8, 1945, pp. 357–359.

*Primary Examiner*—T. M. Tufariello
*Attorney, Agent, or Firm*—Lerner, David, Littenberg & Samuel

[57] ABSTRACT

A method for the treatment of the surface of refining elements or segments is disclosed. The refining segment surfaces, which generally include grooves and ridges, are normally subjected to mechanical polishing or grinding prior to use, thereby smoothing the surface of the ridges of the refining segments and depositing a surface layer of material thereon. This surface layer is removed according to the invention disclosed, by either mechanical or chemical means, in order to permit the uniform wear of the ridges during use, and to roughen that surface. This may be accomplished chemically, for example, by such processes as electrolysis and etching with various acids.

7 Claims, 7 Drawing Figures

METHOD OF TREATING REFINING SEGMENTS

FIELD OF THE INVENTION

The present invention relates to methods for treating the surface of refining segments. More particularly, the present invention relates to methods for removing the surface layer deposited on refining segments, such as those used in refining paper-forming materials, which surface layer is normally deposited on such segments by polishing or grinding thereof. Still more particularly, the present invention relates to methods for treating the surface of refining segments in order to assure the uniform wear of same during use.

BACKGROUND OF THE INVENTION

In the defibering of wood chips, which generally have been pretreated by heat or chemicals, so-called refiners are utilized. Similarly, such refiners are utilized for refining cellulose and other mechanical pulps of various kinds when it is desired to develop the paper-forming properties of these materials by treating them mechanically. In all such defibering or refining operations the desired results are achieved by treating the fiber material mechanically while it is passing through the refiner. Such treatment is generally effected by passing the fiber material, after they have been fed into the refiner by various types of devices, through a clearance between two refining surfaces, which for this purpose are generally provided with grooves and ridges. At least one of these surfaces and at times both such surfaces rotate so that the material is refined in the desired manner and conveyed out of the refiner by the forces of rotation. While generally the refiners are of the disc refiner type, the so-called cone refiners can also be employed.

The intensity and mode of refining these fibrous materials is determined both by the number of ridges and grooves on the refining surfaces and by the width of the clearance therebetween. Thus a narrower clearance as well as a greater number of ridges renders the refining more intensive. Also, in order to enable the performance of the refining work in the refiner and to convey the material therethrough, a certain amount of water must be added to the fiber material, so that a fiber concentration suitable for the particular circumstances in question is obtained. The amount of water supplied and the amount of energy consumed at those particular circumstances in question is decisive as to the temperature which will prevail during the various refining phases, which will thereby effect the refining result obtained.

Consequently, a substantially homogeneous mixture of fiber material, water, and water vapor is conveyed through that narrow clearance between the refining surfaces. The forces of rotation advance the material through the clearance between the refining surfaces at a considerable speed, and the rotating refining surfaces therefore are subjected to heavy wear which may be of both a chemical and mechanical nature.

The particular chemical atmosphere encountered by refining surfaces is relatively well defined for each set of conditions encountered, by the kind of fibers employed, the temperature conditions, the amounts of water and the type of water employed, and thereby also the chemical attack on the material which forms the refining surfaces is also well defined. This material employed for preparing the refining surfaces must therefore be selected accordingly for each such set of conditions. The mechanical breakdown of the profiles and structure of the refining surfaces is also determined by the speed with which each fiber/water mixture is conveyed through the clearance between the refining surfaces, i.e. by the size of the clearance therebetween and by the production which is mirrored by the load on the motor driving the refiners or the amount of energy consumed by the process. This amount of energy is thus transferred from the electric drive motors to the fiber/-water mixture via the refining disc surfaces, and converted into heat.

Therefore, an increase in production increases the energy consumption and thereby the wear on the refining surfaces in exactly the same manner as would a reduction in the clearance between the refining surfaces. In other words, for a given machine size (or given refining surface area) and a given atmosphere, the wear on the refining surface is a function of the specific energy transfer expressed, for example, by kWh per $cm^2$ of available active refining surface. For the production under each set of conditions the material used for the refining surfaces must therefore be selected with the greatest care so as to have the highest possible resistance to the combination of mechanical and chemical acts which take place upon the refining segments. This attack may also be described in terms of corrosion-erosion and a certain gradual wear of the refining surfaces cannot be avoided. A disc refiner therefore is normally divided into refining segments, for obvious practical reasons. These so-called refining segments may thus be exchanged after a certain time when the wear has proceeded so far that it causes process disturbances, or when the refining result is unsatisfactory. These refining segments are manufactured with a pattern and profile in accordance with the kind of work to be carried out in the refiner. The energy transferred to the fibers, and other materials to be refined, via the refining segments provided with ridges, is effected partly by the edges of the ridges and partly be the ridge surfaces. An edge which is therefore sharp and geometrically well defined can transfer more energy than a rounded or irregular edge. This implies, that optimally, the ridge edges must be sharp and intact for as long a period of time as is possible. As wear is unavoidable, wear should optimally take place as far as possible while maintaining the ridge profile. It has thus been attempted to avoid the greatest possible extent of wear by a suitable material selection for the refining segments, since such wear produces rounded ridge edges or heavy break-down of both ridge edges and entire ridges, which rapidly renders proper refining of the fiber material impossible and necessitates frequent exchange of refining segments.

The refining segment ridges should therefore wear uniformly over the edges as well as over the surface of the ridges. It has been attempted to achieve this by choosing for the segments and material which has wear properties on the ridge edge and the ridge surfaces so that they are in balance with the specific energy transfer via the ridge edge and the ridge surface and thus result in a uniform wear. The greater the production through the refiner or the higher the specific energy transfer, the greater will be the wear, as already noted above, on the segment ridges and the easier it generally becomes to find suitable alloys to provide the desired strength balance on the edges and surfaces of the ridges.

When, however, the specific load on the refining surfaces is lighter, a material must be chosen which is less resistant to errosion-corrosion. Otherwise, the wear will be concentrated on the ridges edges which will become rounded after a short time, because the automatic sharpening of the edges as a result of the wear also being distributed over the ridge surfaces would not take place. Since a very large part of the energy is transferred first over the sharp ridges, it will be difficult to transfer sufficient energy for refining the fiber material via the motors of the refiner, and consequently, an unsatisfactory result would be achieved. When it is attempted to compensate for this insufficient refining by reducing the refining clearance which itself renders it possible to transfer more energy to the fibers, difficulties in conveying the fiber material in water through this reduced clearance rapidly arise. In this case, the only remedy is to exchange the segments, because the segment material employed have proven to be too strong. In such case, the effect produced on the ridge surfaces predominantly is that of polishing. In such cases, it is only possible to start up the refining work with these segments because the very sharp ridges of a re-ground segment permits sufficient energy transfer to the fiber materials. Furthermore, a re-ground segment has a certain grinding pattern on the ridge surfaces, which also provides the surface with a certain "roughness" with friction properties resulting therefrom. This grinding pattern, however, is generally rapidly worn off.

It is therefore necessary in each particular application to select a material for the refining segments which is adapted for the purposes in question and from which the segments are to be cast. After casting, the segments are generally ground with a high degree of precision to an accurate profile and correct dimensions before use. The grinding process, however, such as generally carried out, requires that for most materials the surface of the segment ridges is subjected to polishing and therefore covered with a thin layer of material having a structure other than that of the material employed to prepare the segments, this layer being generally of a thickness of some hundreds of millimeters. Thus, while the selected material is generally suitable in all respects for the work for which it is intended to be used, and for the specific energy transfer involved, the ridge surface in ready state nevertheless has been covered by the grinding operation with a layer of polished material, which renders it unsuitable for the energy transfer aspect.

In certain cases, when the production through the refiner is sufficiently great, or the specific energy transfer via the ridges is sufficiently high, this thin layer of polished surface material can be worn off. The higher the specific energy transfer, the more rapidly the working of the polished layer proceeds. During this "adaptation period", substantial process disturbance may arise because the polished layer does not have the properties suitable for the fiber refining as does the material beneath this surface layer. The layer of polished material thus renders the employment of such segments difficult if not impossible.

SUMMARY OF THE INVENTION

According to the present invention a method for treating the polished surface layer produced during the grinding of refining segment ridges is removed prior to the use of such segments. As a result thereof, the surface of the refining segments wears substantially uniformly during use, and furthermore, the ridge surfaces show the same basic desired properties of the segment material so that from the outset fiber refining of the desired nature is attained. Therefore, no adaptation period is required, and, consequently, potentially serious process disturbances are avoided.

Specifically, the removal of the polished surface layer resulting from the initial grinding of the refining segment ridges is removed by either a mechanical or chemical process.

The present invention is described in greater detail, with specific reference to the following drawings in which:

FIG. 1 shows a top elevational view of a conventional refining segment;

FIG. 2*a* through 2*c* show a front cross-sectional view of a portion of a conventional refining segment, showing gradual wear of the ridges while maintaining ridge profiles according to the present invention;

FIG. 3 shows an enlarged top view of the surface of a portion of a ground ridge surface; and FIG. 4 and 5 show an enlarged top view of the ridge surfaces of a refining segment treated according to the present invention.

DETAILED DESCRIPTION

As discussed above, the removal of the polished layer resulting from grinding of the segment ridges may be effected by either a mechanical or chemical process. In the mechanical removal of such polished layer, this must be accomplished in a very precies manner in order to avoid unacceptable high surface temperatures.

For example, the mechanical removal of the polished layer could be accomplished by means of honing. This can be carried out either by hand, i.e., by drawing a honing stone over the polished surface, or by means of conventional honing machinery. In both cases it is possible to remove the polished layer while avoiding any high temperature rise therein. For this reason when employing a honing machine, for example, the hone stone should be rotated at relatively low speeds.

On the other hand, the chemical removal of the polished surface layer may be prepared by several means, including etching and electrolysis.

In etching, for example, the particular etching bath employed will depend upon the characteristics of the particular alloy of which the refining segment is composed.

The particular type of chemical attack employed to remove the polished surface layer can take place in a selective and restricted manner by a suitable choice of chemicals and method employed. The chemical attack carried out according to this invention is thus a directed attack which primarily removes the undesired polished surface layer, but which also loosens the underlining material, i.e., the basic structure of the ridges. This results in a tarnished surface which can apply high degrees of friction to the material which is to be ground to the refining segment. As an example thereof, such a selective desired attack on the polished surface layer can result in carbides being left on the segment surface, and they will thus constitute the desired tarnished structure.

In this manner, the ridged surfaces assume a non-uniform and irregular micro-structure which is highly favorable for effecting refining of fibers, and which also enables a sufficiently high energy transfer to the fiber materials from the ridged surface. By modifying the chemical attack on the material, the surface structure can be given different appearances, such as is done in the example included herein to thereby effect the fiber refining properties, and the refining capacity of the materials employed.

Figure 2A:
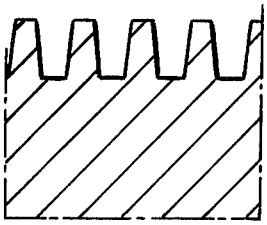
Figure 2B:
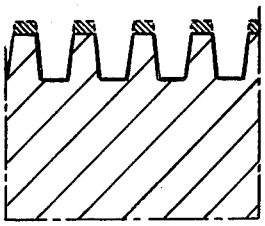
Figure 2C:
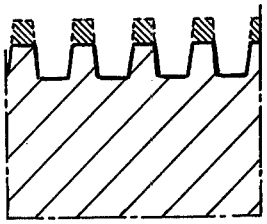

The uneven and loosened microstructure of the ridge surfaces also facilitates a uniform and continuous wear of the ridges themselves, so that their profile is maintained as shown in FIGS. 2*a* through 2*c*. This is so because of the fact that the acids released from the fibrous materials during their processing can now more easily attack the material structure loosened by the selective chemical attack such as etching. If the polished surface layer had been left in tact this attack would have been much more difficult. Thus, in such a case, in many instances the material becomes even more polished, and the breakdown of the ridges is then concentrated along its edges. The ridge profile can quickly become rounded, and a continuous utilization of the segments is made difficult if not impossible.

It is therefore possible by employing the process of the present invention, and particularly by the chemical treatment of the re-ground ridge surfaces of the refining segments, to fully utilize and improve the refining properties of the segments themselves, as well as to insure a uniform and correct wear of the segment ridges from the very beginning of their utilization. In this manner, an optinum refining process and a maximum service life for the segments utilized is attained.

DESCRIPTION OF THE PREFERRED EMBODIMENTS

The present invention may also be more fully gleaned from the following examples.

EXAMPLE 1

Figure 1:
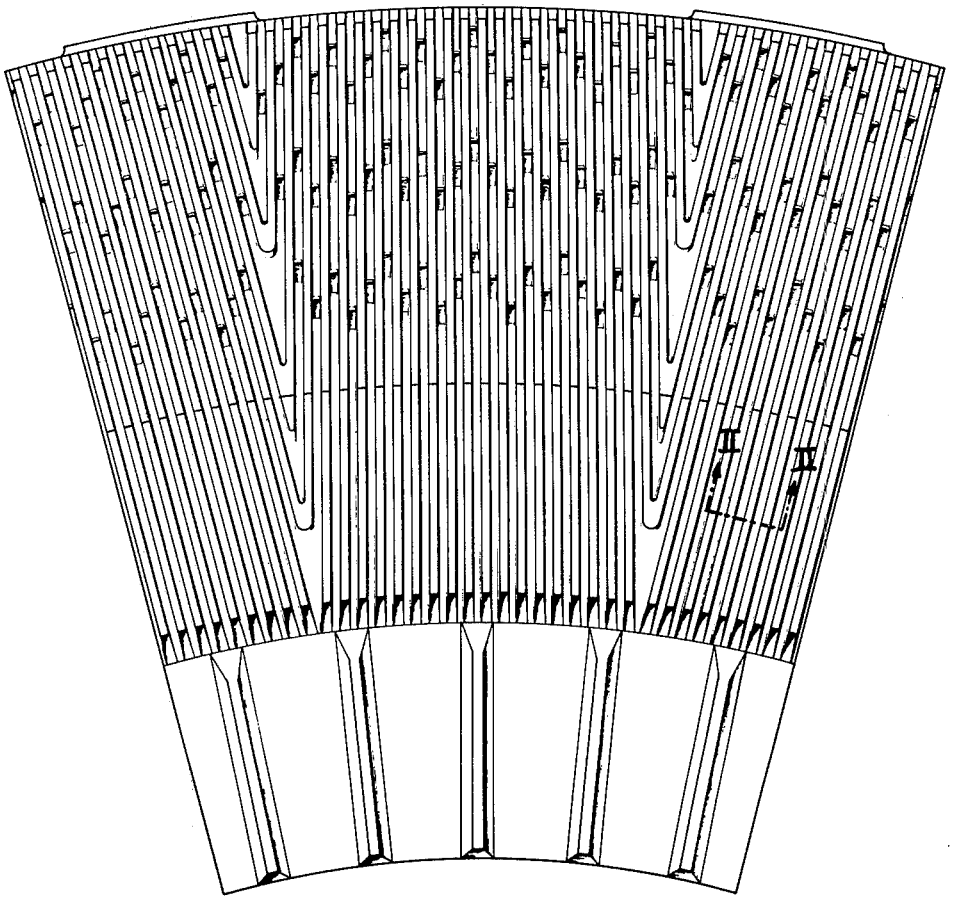
Figure 3:
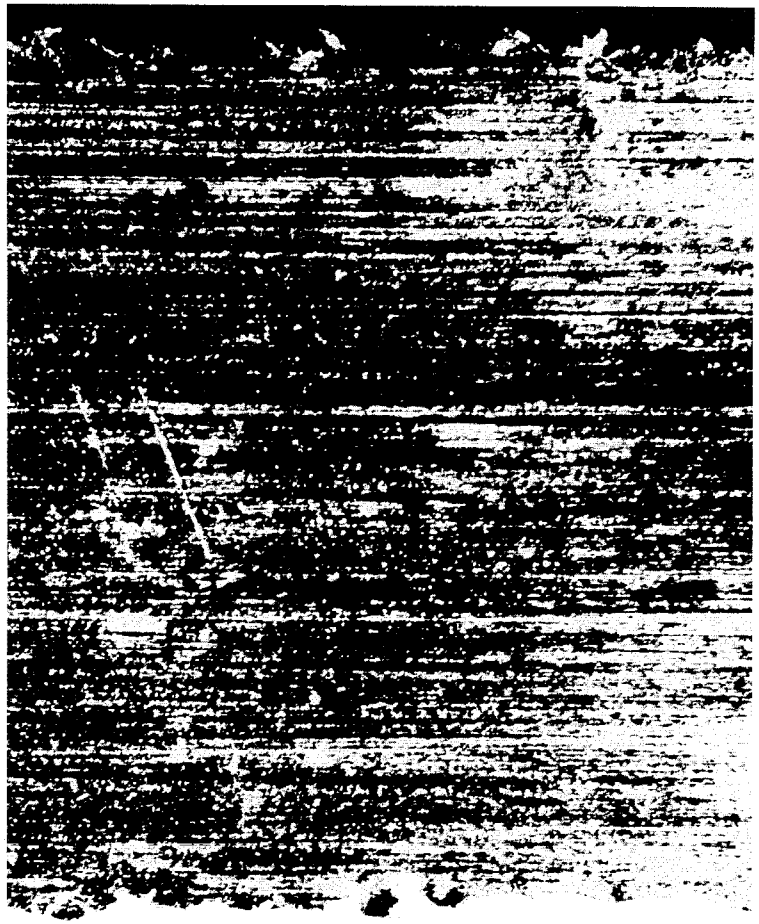

A conventional refining segment (FIG. 1) cast of alloyed steel, was ground on the pattern side in the usual manner, and the resulting surface of the ridges was smooth with grinding streaks. Such a surface is shown in FIG. 3 enlarged 50 times.

Figure 4:
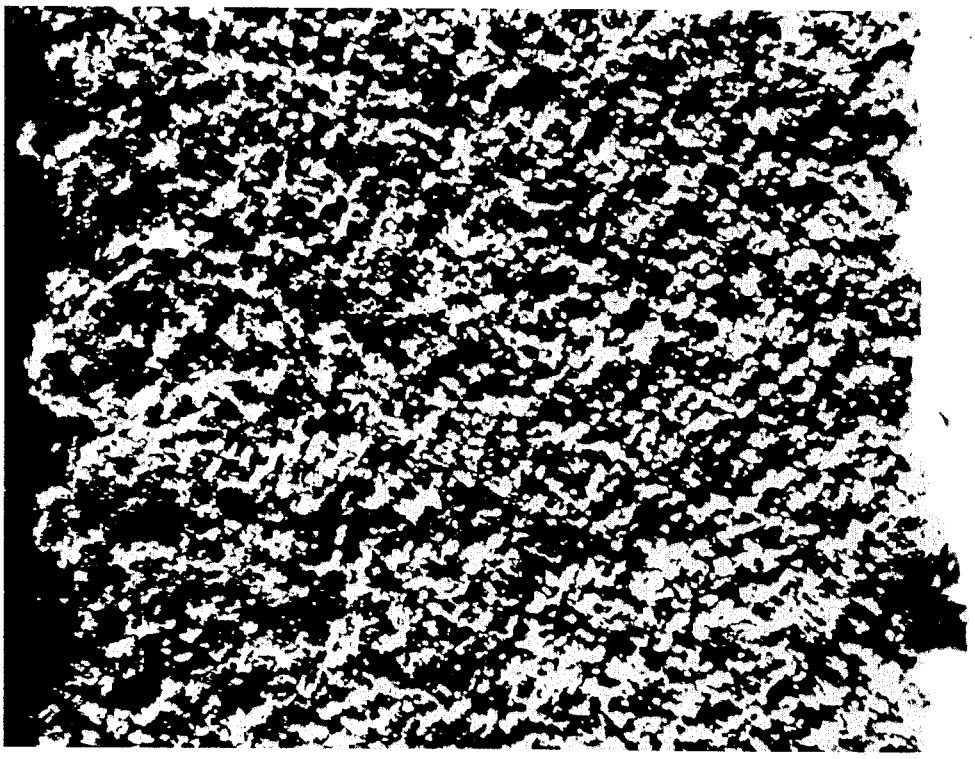

The pattern side, i.e., containing the ridges and grooves, was then immersed in a bath containing 10% nitric acid by volume, and 1% hydrofluoric acid by volume. The bath temperature was 40° C, and after 30 minutes the refining segment was lifted out of the bath and rinsed. The rinsed surfaces then showed a rough structure, which structure is shown in FIG. 4, also enlarged 50 times.

EXAMPLE 2

Figure 5:
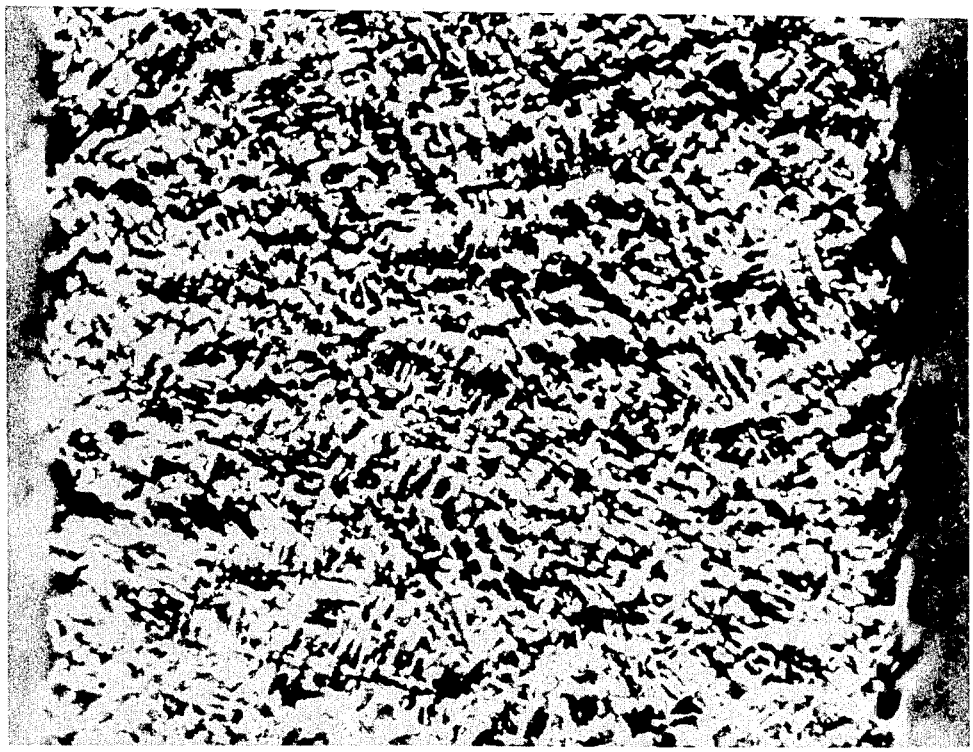

A similar conventional refining segment (FIG. 1) case of alloyed steel was ground as in Example 1. The pattern side was then immersed in a bath containing 8% sulfuric acid, by volume, 1% hydrofluoric acid by volume, and 1% hydrochloric acid, by volume. The bath temperature in this case was 70° C, and after 60 minutes the refining segment was lifted out of the bath and rinsed. The ridge surfaces then showed a rough structure as shown in FIG. 5, again enlarged 50 times.

What is claimed is:

1. A method for treating the metal surface of refining elements to be employed in the defibering of cellulosic materials, said surface including grooves and ridges, which comprises polishing the metal surface of said ridges by grinding, thereby adding a polished surface layer to said ridge surfaces, removing said added surface layer prior to use of said refining elements in said defibering and attacking the surface of said refining elements, thereby loosening the microstructure and roughening the surface of said refining element, so that said surface of said refining element will wear substantially uniformly during use, said removal of said added surface layer being subsequent to any polishing of the surface of said ridges, so that said surface of said ridges is substantially free of any added polished surface layer and includes a loosened microstructure and a roughened surface during use thereof.

2. The method of claim 1 wherein the said surface layer is removed by chemical means.

3. The method of claim 2 wherein said chemical means comprises etching.

4. The method of claim 3 wherein said etching is carried out by employing an acid selected from the group consisting of nitric acid, hydrofluoric acid, sulfuric acid, hydrochloric acid and mixtures thereof.

5. The method of claim 6 wherein said mechanical means comprises honing.

6. The method of claim 1 wherein said surface layer is removed by mechanical means.

7. The method of claim 2, wherein said chemical means comprises electrolysis.

* * * * *